US009967662B2

(12) United States Patent
Yang

(10) Patent No.: US 9,967,662 B2
(45) Date of Patent: May 8, 2018

(54) MICROPHONE DEVICE

(71) Applicant: Fortemedia, Inc., Santa Clara, CA (US)

(72) Inventor: Tsung Lung Yang, Santa Clara, CA (US)

(73) Assignee: FORTEMEDIA, INC., Santa Clara, CA (US)

( * ) Notice: Subject to any disclaimer, the term of this patent is extended or adjusted under 35 U.S.C. 154(b) by 0 days. days.

(21) Appl. No.: 15/587,528

(22) Filed: May 5, 2017

(65) Prior Publication Data

US 2018/0077489 A1 Mar. 15, 2018

Related U.S. Application Data

(60) Provisional application No. 62/393,249, filed on Sep. 12, 2016.

(51) Int. Cl.

| | |
|---|---|
| ***H04R 3/00*** | (2006.01) |
| ***H04R 1/04*** | (2006.01) |
| ***H04R 1/40*** | (2006.01) |
| ***H04R 1/28*** | (2006.01) |
| ***H04R 19/04*** | (2006.01) |

(52) U.S. Cl.

CPC ..... *H04R 3/005* (2013.01); *H04R 1/04* (2013.01); *H04R 1/2853* (2013.01); *H04R 1/406* (2013.01); *H04R 19/04* (2013.01); *H04R 2201/003* (2013.01)

(58) Field of Classification Search

CPC ..... H04R 3/005; H04R 1/04; H04R 1/2853; H04R 1/406; H04R 19/04

USPC ..... 381/91–92

See application file for complete search history.

(56) References Cited

U.S. PATENT DOCUMENTS

| | | | | |
|---|---|---|---|---|
| 8,638,955 | B2 * | 1/2014 | Takano | H04R 1/04 381/122 |
| 2010/0260346 | A1 * | 10/2010 | Takano | H04R 1/04 381/71.1 |
| 2011/0158454 | A1 * | 6/2011 | Takano | H04R 1/04 381/369 |
| 2014/0299948 | A1 * | 10/2014 | Wang | H04R 19/005 257/416 |
| 2015/0023523 | A1 * | 1/2015 | Elian | H04R 1/083 381/91 |

* cited by examiner

*Primary Examiner* — Disler Paul

(74) *Attorney, Agent, or Firm* — McClure, Qualey & Rodack, LLP

(57) ABSTRACT

A microphone device is provided, including first and second chambers, first and second acoustic sensors, and a sound transmission device. The first and second chambers include the first and second acoustic ports, respectively. The first and second acoustic sensors are arranged in the first chamber and the second chamber, respectively. The sound transmission device coupled to the first and second chambers includes third and fourth acoustic ports, a first acoustic tube, and a second acoustic tube. The first acoustic tube communicates with the first acoustic port and the third acoustic port. The second acoustic tube communicates with the second acoustic port and the fourth acoustic port. The sensitivity difference between the first acoustic sensor and the second acoustic sensor is determined based on the length difference or the cross-sectional area difference between the first acoustic tube and the second acoustic tube.

10 Claims, 12 Drawing Sheets

MICROPHONE DEVICE

CROSS REFERENCE TO RELATED APPLICATIONS

This application claims the benefit of U.S. Provisional Application No. 62/393,249, filed on Sep. 12, 2016, the entirety of which is incorporated by reference herein.

BACKGROUND OF THE INVENTION

Field of the Invention

The present invention relates to a microphone device, and in particular it relates to a directional microphone device which supports different sensitivities.

Description of the Related Art

Currently, most microphone devices are capacitive microphones in which micro-electro mechanical system (MEMS) microphones are widely used. A MEMS microphone uses MEMS, which can integrate electronic, electrical, and mechanical functions into a single device. Therefore, a MEMS microphone may have the advantages of a small size, low power consumption, easy packaging, and resistance to interference.

In general, a directional microphone has a better signal-to-noise ratio and an improved performance in the microphone device's acoustic signal processing. If the dynamic range of the microphone increases, then the microphone can correctly receive a wider range of volume. Therefore, it is desirable to have a directional microphone device which supports a wide dynamic range.

BRIEF SUMMARY OF THE INVENTION

A detailed description is given in the following embodiments with reference to the accompanying drawings.

The present disclosure provides a microphone device. The microphone device comprises a first chamber, a second chamber, a first acoustic sensor, a second acoustic sensor and a sound transmission device. The first chamber comprises a first acoustic port. The second chamber comprises a second acoustic port. The first acoustic sensor is arranged in the first chamber. The second acoustic sensor is arranged in the second chamber. The sound transmission device is coupled to the first chamber and the second chamber. The sound transmission device comprises a third acoustic port, a fourth acoustic port, a first acoustic tube and a second acoustic tube. The first acoustic tube communicates with the first acoustic port and the third acoustic port, and the second acoustic tube communicates with the second acoustic port and the fourth acoustic port. The directivity of the microphone device is determined based on the length difference between the first acoustic tube and the second acoustic tube or determined based on the cross-sectional area difference between the first acoustic tube and the second acoustic tube. The sensitivity difference between the first acoustic sensor and the second acoustic sensor is determined based on the length difference or determined based on the cross-sectional area difference.

The present disclosure provides a control method of a microphone device, comprising: determining the sensitivity difference between a first acoustic sensor inside a first chamber of the microphone device and a second acoustic sensor inside a second chamber of the microphone device based on the length difference between a first acoustic tube and a second acoustic tube of a sound transmission device of the microphone device or based on the cross-sectional area difference between the first acoustic tube and the second acoustic tube; and determining directivity of the microphone device based on the length difference or the cross-sectional area difference.

The sound transmission device is coupled to the first chamber and the second chamber. The first acoustic tube communicates with a first acoustic port of the first chamber and a third acoustic port of the sound transmission device, and the second acoustic tube communicates with a second acoustic port of the second chamber and a fourth acoustic port of the sound transmission device.

BRIEF DESCRIPTION OF THE DRAWINGS

The present disclosure can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
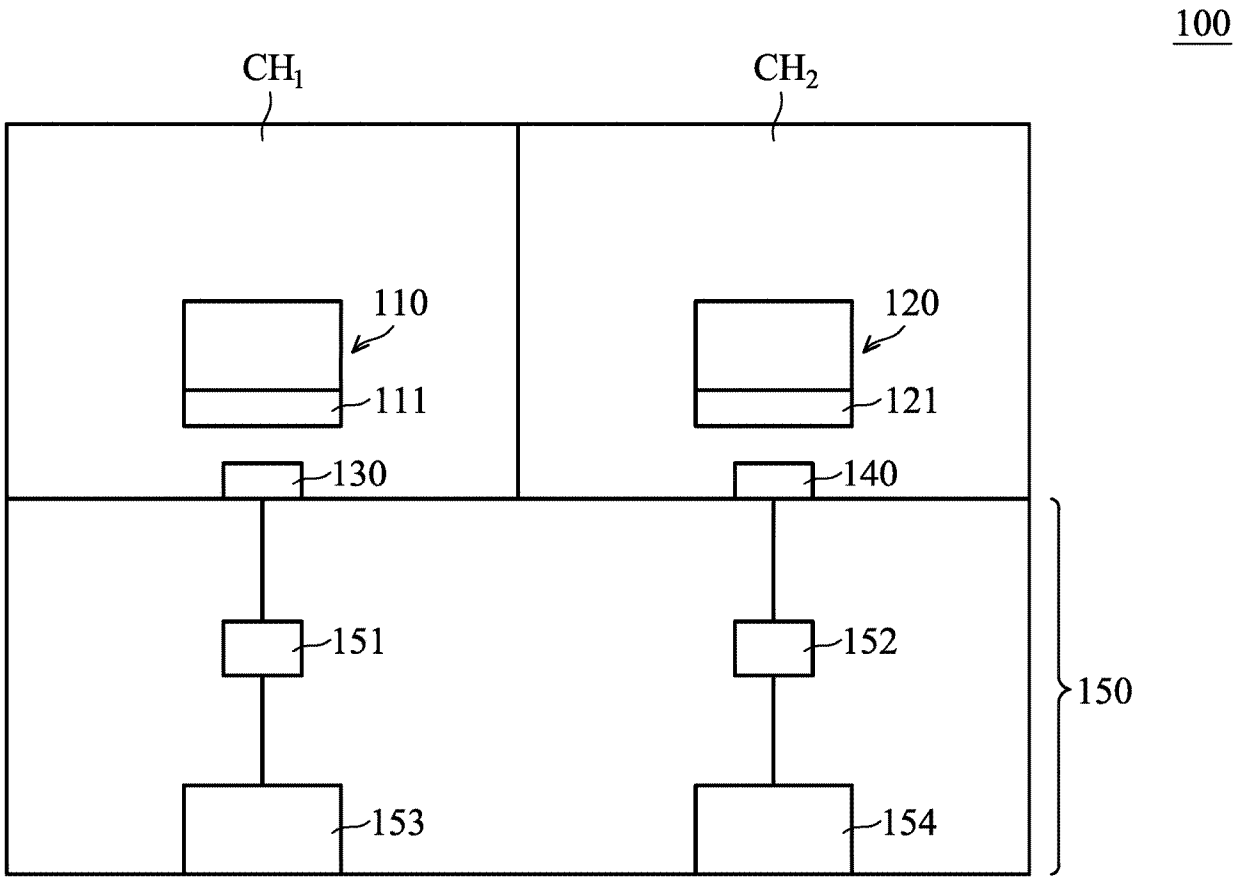
FIG. 1 is a schematic diagram of a microphone device according to an embodiment of the present disclosure.

FIG. 1 is a schematic diagram of a microphone device 100 according to an embodiment of the present disclosure. The microphone device 100 includes the chamber $CH_1$, the chamber $CH_2$, the acoustic sensor 110, the acoustic sensor 120 and the sound transmission device 150. The chamber $CH_1$ comprises the acoustic port 130, and the chamber $CH_2$ comprises the acoustic port 140. In some embodiments, the acoustic sensor 110 and acoustic sensor 120 are the micro-electro mechanical system (MEMS) devices.

The acoustic sensor 110 includes the diaphragm 111, and the acoustic sensor 120 includes the diaphragm 121. The sound transmission device 150 coupled to the chambers $CH_1$ and $CH_2$ includes the acoustic tube 151, the acoustic tube 152, the acoustic port 153 and the acoustic port 154. The acoustic tube 151 communicates with the acoustic port 130 and the acoustic port 153. The acoustic tube 152 communicates with the acoustic port 140 and the acoustic port 154.

In some embodiments, the length difference between the acoustic tubes 151 and 152 or the cross-sectional area difference between the acoustic tube 151 and the acoustic tube 152 can determine directivity of the microphone device 100. In some embodiments, the length difference between the acoustic tubes 151 and 152 or the cross-sectional area difference between the acoustic tube 151 and the acoustic tube 152 (e.g., the volume difference between the acoustic tubes 151 and 152) can determine the sensitivity difference between the acoustic sensors 110 and 120.

As shown in FIG. 1, the acoustic port 130 corresponds to the position of the diaphragm 111, and the acoustic port 140 corresponds to the position of the diaphragm 121. In some embodiments, when the sound wave is propagated from the acoustic port 153 to the acoustic port 130, the sound wave is transmitted to the diaphragm 111 rather than diaphragm 121. Similarly, when the sound wave is propagated from the acoustic port 154 to the acoustic port 140, the sound wave is transmitted to the diaphragm 121 rather than diaphragm 111. In such cases, the acoustic sensor 110 is not interrupted by the sound wave transmitted to the acoustic sensor 120, and the acoustic sensor 120 is not interrupted by the sound wave transmitted to the acoustic sensor 110. Accordingly, the performance of the directivity of the microphone device 100 is improved.

In some embodiments, the size of the diaphragm 111 and the size of the diaphragm 121 are different, so the rigidity of the diaphragm 111 and the rigidity of the diaphragm 121 are also different, which makes the sensitivity of the acoustic sensor 110 different from the sensitivity of the acoustic sensor 120 and increases the dynamic range of the microphone device 100. In some embodiments, the acoustic tube 151 and the acoustic tube 152 may be different lengths or have different cross-sectional areas. In such cases, when the sound wave is transmitted to the diaphragm 111 and the diaphragm 121 through the acoustic tube 151 and the acoustic tube 152, respectively, the sound degradation caused by the acoustic tube 151 and that caused by the acoustic tube 152 are different, which makes the sensitivity of acoustic sensor 110 different from the sensitivity of the acoustic sensor 120 and increases the dynamic range of the microphone device 100.

Figure 2A:
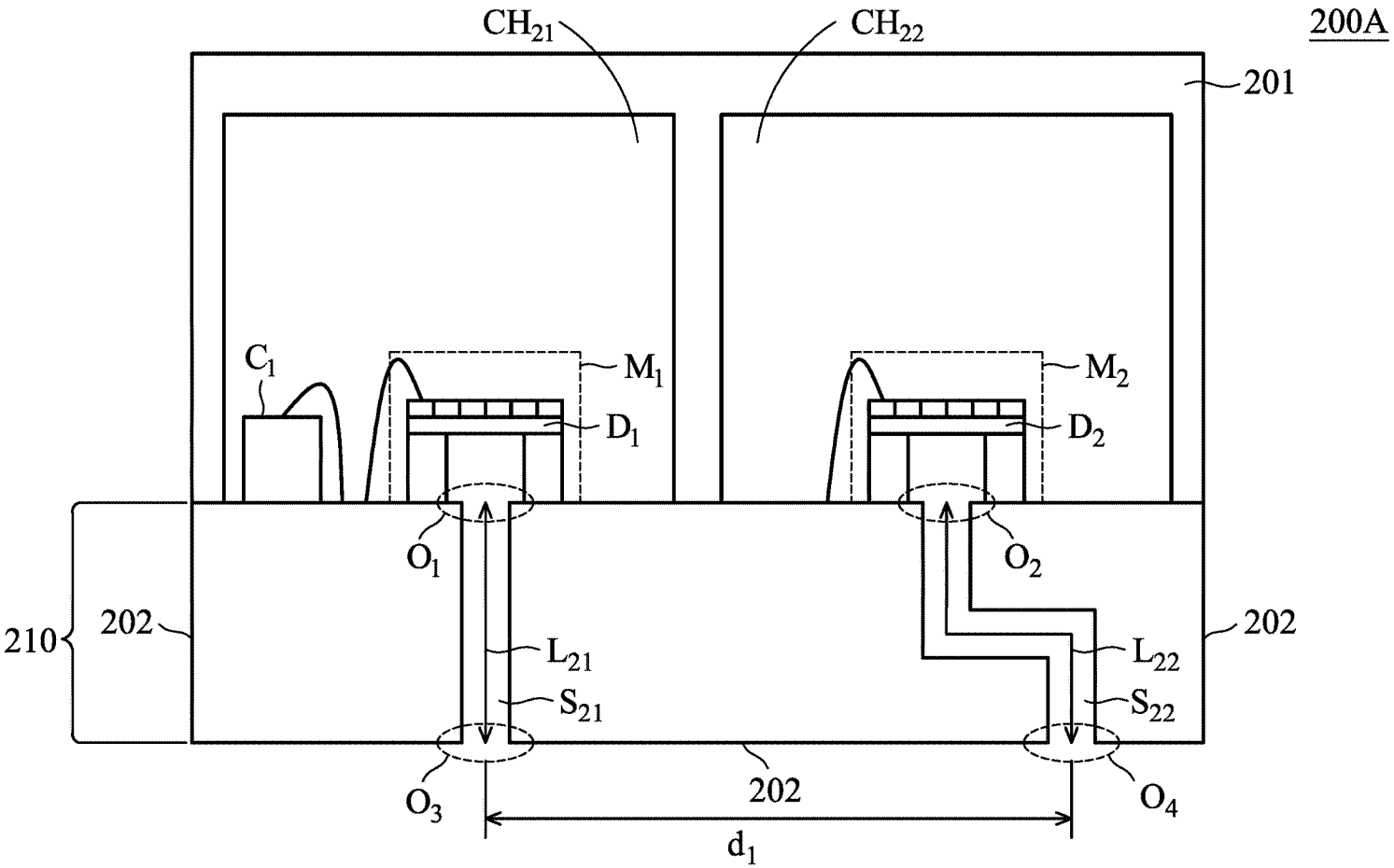
FIG. 2A-2B is a schematic diagram of a microphone device according to an embodiment of the present disclosure.

Specifically, one embodiment related to the microphone device described above is illustrated in FIG. 2A. FIG. 2A is a schematic diagram of a microphone device 200A according to an embodiment of the present disclosure. The microphone device 200A includes the chamber $CH_{21}$, the chamber $CH_{22}$, the acoustic sensor $M_1$, the acoustic sensor $M_2$ and the sound transmission device 210.

The chamber $CH_{21}$ and chamber $CH_{22}$ are formed by the microphone cover 201 and the circuit board 202 which are coupled to each other. The sound transmission device 210 is formed by the circuit board 202. The chamber $CH_{21}$ includes the acoustic port $O_1$, and the chamber $CH_{22}$ includes the acoustic port $O_2$. The acoustic sensor $M_1$ and the integrated circuit $C_1$ are placed inside the chamber $CH_{21}$, and the acoustic sensor $M_2$ is placed inside the chamber $CH_{22}$. The circuit board 202 includes the acoustic tube $S_{21}$, the acoustic tube $S_{22}$, the acoustic port $O_3$, and the acoustic port $O_4$. The acoustic tube $S_{21}$ communicates with the acoustic port $O_1$ and the acoustic port $O_3$, and the acoustic tube $S_{22}$ communicates with the acoustic port $O_2$ and the acoustic port $O_4$.

As shown in FIG. 2A, the acoustic sensor $M_1$ includes diaphragm $D_1$, and the acoustic sensor $M_2$ includes diaphragm $D_2$. The acoustic port $O_1$ corresponds to the position of the diaphragm $D_1$, which makes the diaphragm $D_1$ receive sound transmitted from the acoustic port $O_1$. The acoustic port $O_2$ corresponds to the position of the diaphragm $D_2$, which makes the diaphragm $D_2$ receive sound transmitted from the acoustic port $O_2$.

The integrated circuit $C_1$ is coupled to the acoustic sensor $M_1$ and the acoustic sensor $M_2$ to provide voltage to the acoustic sensors $M_1$ and $M_2$ and process the signals received from the acoustic sensors $M_1$ and $M_2$. In some embodiments, the signals received from the acoustic sensors $M_1$ and $M_2$ respectively correspond to the vibrations of the diaphragms D1 and D2 in response to the sound. In some embodiments, the integrated circuit $C_1$ may provide different respective voltages to the acoustic sensor $M_1$ and the acoustic sensor $M_2$, which makes the distance between the diaphragm $D_1$ and the back-plate (not shown in FIG. 2A) of the acoustic sensor M1 different from the distance between the diaphragm $D_2$ and the back-plate (not shown in FIG. 2A) of the acoustic sensor $M_2$. In such cases, the sensitivity of the acoustic sensor $M_1$ is different from the sensitivity of the acoustic sensor $M_2$, which increases the dynamic range of the microphone device 200A. In some embodiments, the integrated circuit $C_1$ may control the directivity of the microphone device 200A by controlling the acoustic sensor $M_1$ and acoustic sensor $M_2$ and processing the signals received by the acoustic sensor $M_1$ and acoustic sensor $M_1$ (e.g., adding additional delay to one of the signals).

In this embodiment, the length $L_{21}$ of the acoustic tube $S_{21}$ is shorter than the length $L_{22}$ of the acoustic tube $S_{22}$. Accordingly, the sound path (or propagation path) of the sound transmitted to the diaphragm $D_1$ through the acoustic tube $S_{21}$ is shorter than the sound path of the sound transmitted to the diaphragm $D_2$ through the acoustic tube $S_{22}$. Based on the distance $d_1$ and the different length between the acoustic tube $S_{21}$ and the acoustic tube $S_{22}$, the sound may substantially reach both the diaphragm $D_1$ and the diaphragm $D_2$ at the same time that the sound is substantially transmitted in a specific direction. In such cases, the acoustic tube $S_{21}$, the acoustic tube $S_{22}$, and the distance $d_1$ may determine the directivity of the microphone device 200A.

Since the sound path of the acoustic tube $S_{22}$ is longer than the sound path of the acoustic tube $S_{21}$, the sound degradation caused by the acoustic tube $S_{22}$ is greater than the sound degradation caused by the acoustic tube $S_{21}$. In such cases, the sensitivity of the acoustic sensor $M_1$ may be better than the sensitivity of the acoustic sensor $M_2$ (i.e., the acoustic sensor $M_1$ is more sensitive than the acoustic sensor $M_2$), which makes the microphone device 200A support two different sensitivities and makes the microphone device 200A have a wider dynamic range. Therefore, the sound transmission device 210 including the acoustic tubes $S_{21}$ and $S_{22}$ can be utilized to determine the directivity of the microphone device 200A and make the microphone device 200A have a wide dynamic range.

In some embodiments, the acoustic tube $S_{21}$ and the acoustic tube $S_{22}$ may have different cross-sectional areas. Since different cross-sectional areas cause different sound degradations, the dynamic range and the directivity of the microphone device 200A can be designed based on different cross-sectional areas of the acoustic tube $S_{21}$ and the acoustic tube $S_{22}$.

Figure 2B:
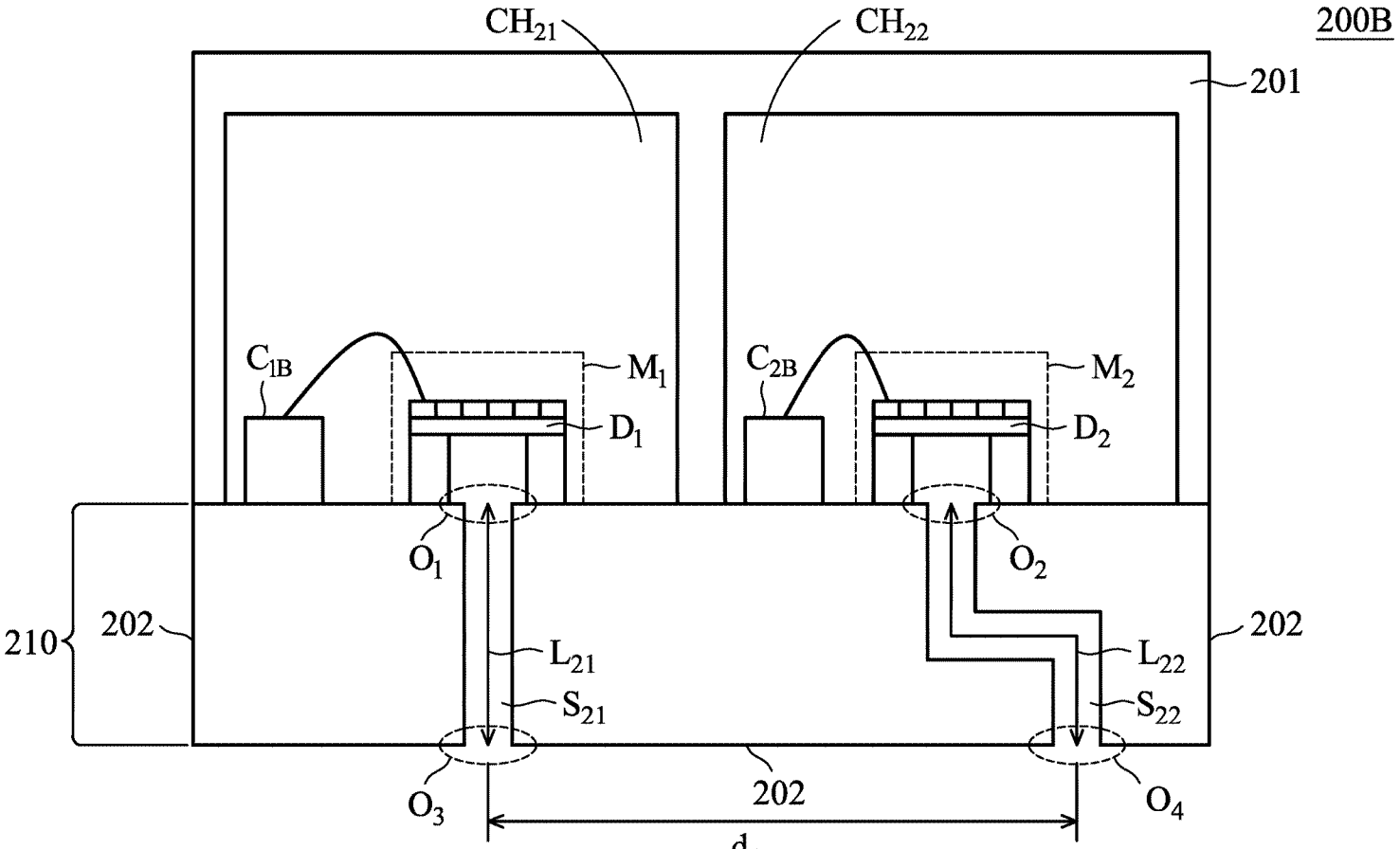

FIG. 2B is a schematic diagram of a microphone device 200B according to an embodiment of the present disclosure. The difference between the microphone device 200A and the microphone device 200B are the integrated circuits $C_{1B}$ and $C_{2B}$. The integrated circuits $C_{1B}$ and $C_{2B}$ are coupled to the acoustic sensor $M_1$ and the acoustic sensor $M_2$, respectively. The integrated circuits $C_{1B}$ and $C_{2B}$ may perform functions of the integrated circuit $C_1$ which are described above. In some embodiments, the integrated circuits $C_1$, $C_{1B}$ and $C_{2B}$ include the digital-signal-processing (DSP) circuit, Digital/Analog converter and operational amplifier. In this embodiment, the chambers $CH_{21}$ and $CH_{22}$ have the same size, and the arrangement of the integrated circuit $C_{1B}$ and the acoustic sensor $M_1$ in the chamber $CH_{21}$ is the same as the arrangement of the integrated circuit $C_{2B}$ and the acoustic sensor $M_2$ in the chamber $CH_2$. Therefore, the environments in the chambers $CH_{21}$ and $CH_{22}$ are the same, which makes the difference between sounds respectively received by the acoustic sensors $M_1$ and $M_2$ are mainly caused by the difference sound paths between the acoustic tubes $S_{21}$ and $S_{22}$. In such cases, the accuracy of directivity of the microphone device 200B is improved.

In some embodiments, the circuit board 202 may include multiple layers. In some embodiments, the circuit board 202 may consist of different circuit boards. For example, the acoustic port $O_1$ and acoustic port $O_2$ are placed on a first circuit board, and the acoustic port $O_3$ and acoustic port $O_4$ are placed on a second circuit board which coupled to the first circuit board.

Figure 3:
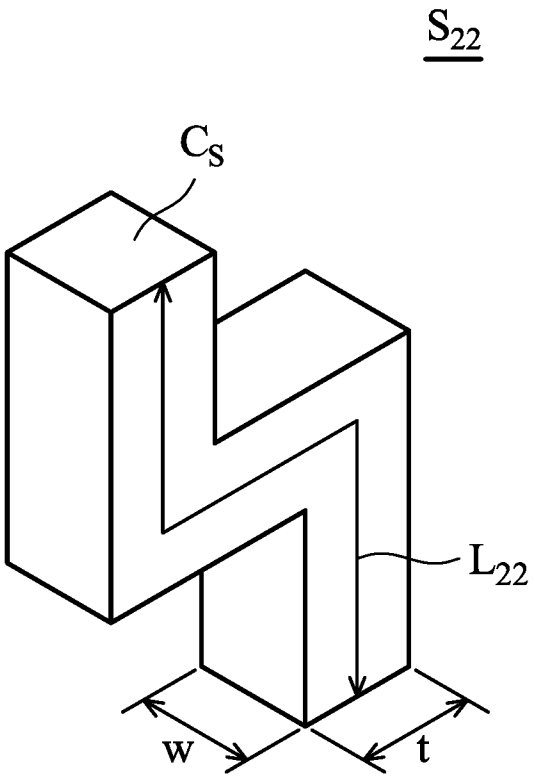
FIG. 3 is a schematic diagram of an acoustic tube according to an embodiment of the present disclosure.

FIG. 3 illustrates the acoustic tube $S_{22}$. If the cross-sectional area Cs of the acoustic tube $S_{22}$ becomes larger (i.e. the length t or the length w becomes longer), then the acoustic tube $S_{22}$ receives more sound energy and then reduces the sound degradation caused by the acoustic tube $S_{22}$, as shown in FIGS. 4A-4B.

Figure 4A:
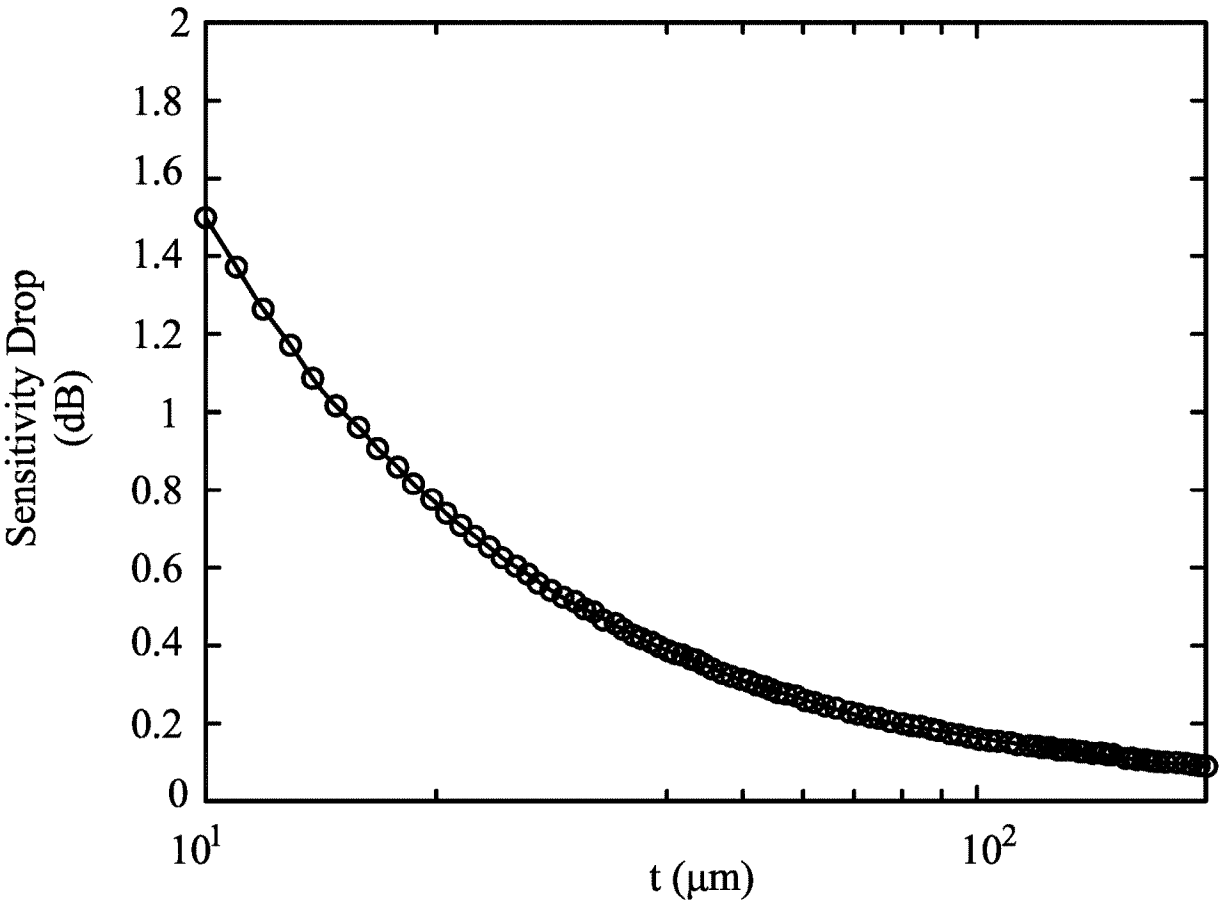
FIG. 4A-4B is a chart illustrating the relationship between the cross-sectional area of the acoustic tube section and the sensitivity of the microphone according to some embodiments of the present disclosure.
Figure 4B:
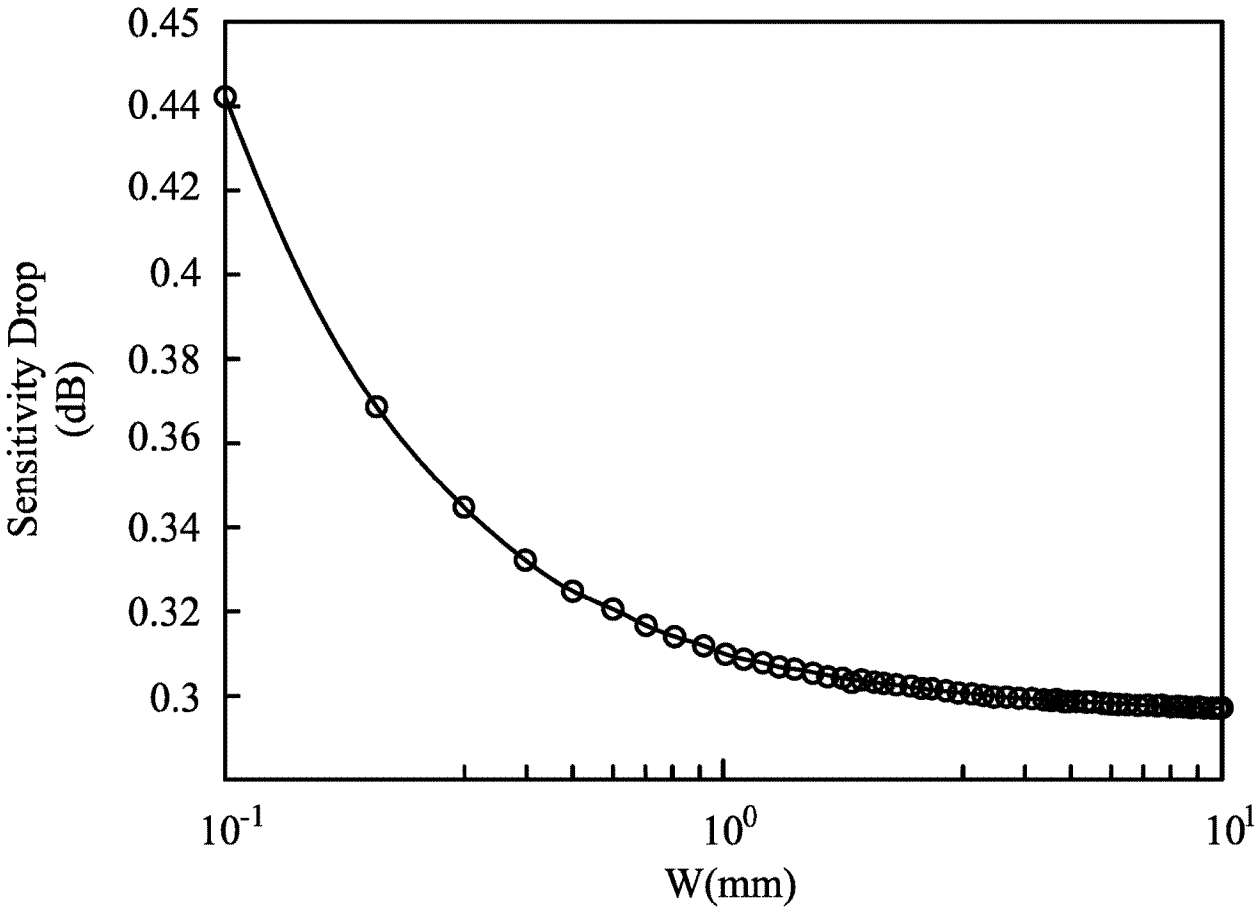

FIG. 4A is a chart showing the relationship between the length t and the sensitivity of the acoustic sensor $M_2$ when the length w and length $L_{22}$ of the acoustic tube $S_{22}$ are 0.8 mm and 0.85 mm, respectively. As shown in FIG. 4A, the sensitivity degradation (or the sensitivity drop) of the acoustic sensor $M_2$ is reduced when the length t is increased (i.e. the cross-sectional area is increased). Similarly, FIG. 4B is a chart showing the relationship between the length w and the sensitivity of the acoustic sensor $M_2$ when the length $L_{22}$ and length t of the acoustic tube $S_{22}$ are 0.085 mm and 0.05 mm, respectively. As shown in FIG. 4B, the sensitivity degradation of the acoustic sensor $M_2$ is reduced when the length w is increased. In some embodiments, the cross-sectional area Cs may be any shape.

Figure 4C:
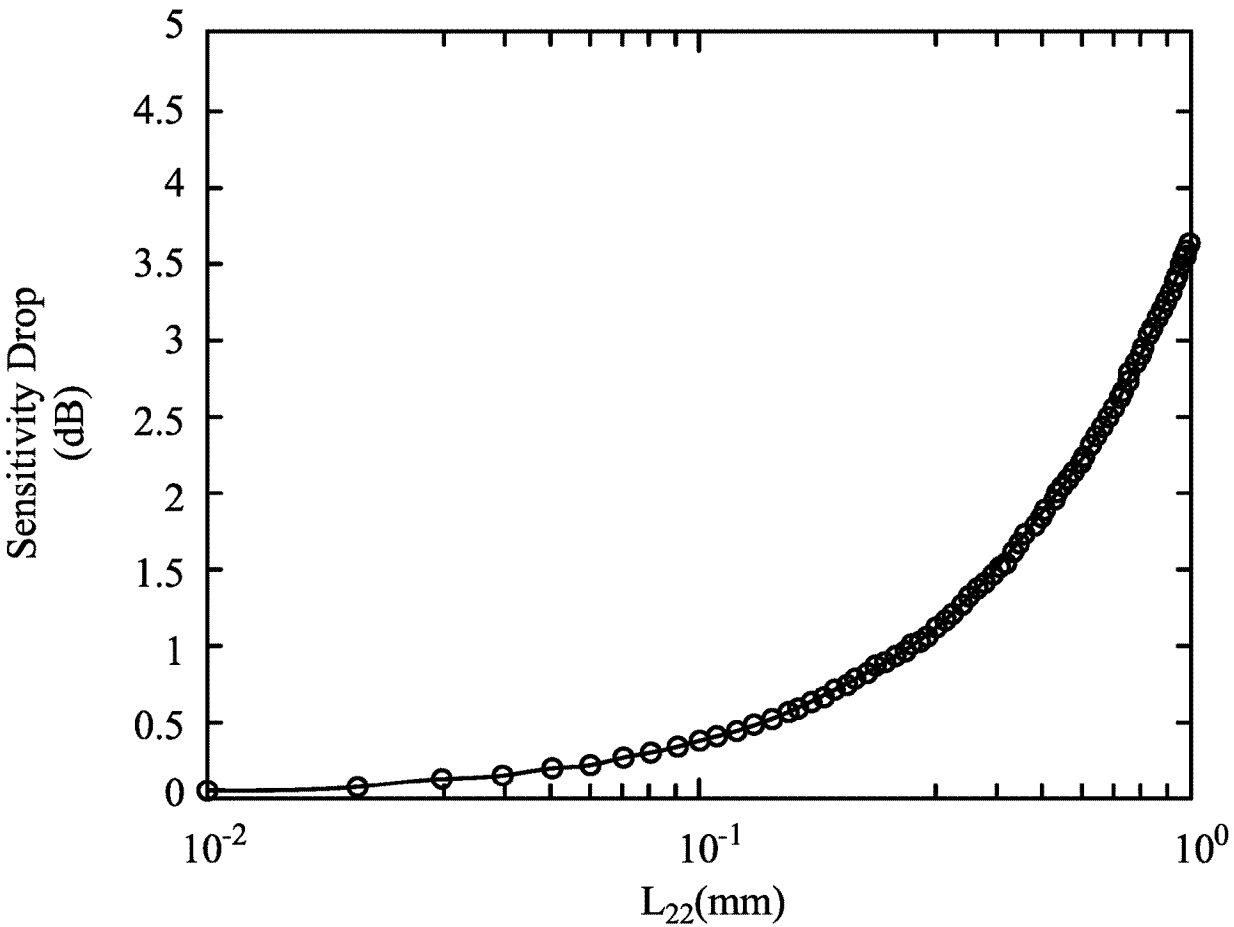
FIG. 4C is a chart illustrating the relationship between the length of the acoustic tube and the sensitivity of the microphone according to some embodiments of the present disclosure.

If the length $L_{22}$ of the acoustic tube $S_{22}$ becomes longer, then the sound path in the acoustic tube $S_{22}$ also become longer, which increases the sound degradation caused by the acoustic tube $S_{22}$, as shown in FIG. 4C. FIG. 4C is a chart showing the relationship between the length $L_{22}$ and the sensitivity of the acoustic sensor $M_2$ when the length w and the length t of the acoustic tube section $S_{22}$ are 1.1 mm and 0.05 mm, respectively. As shown in FIG. 4C, the sensitivity degradation (or the sensitivity drop) of the acoustic sensor $M_2$ is increased when the length $L_{22}$ is increased.

Figure 5:
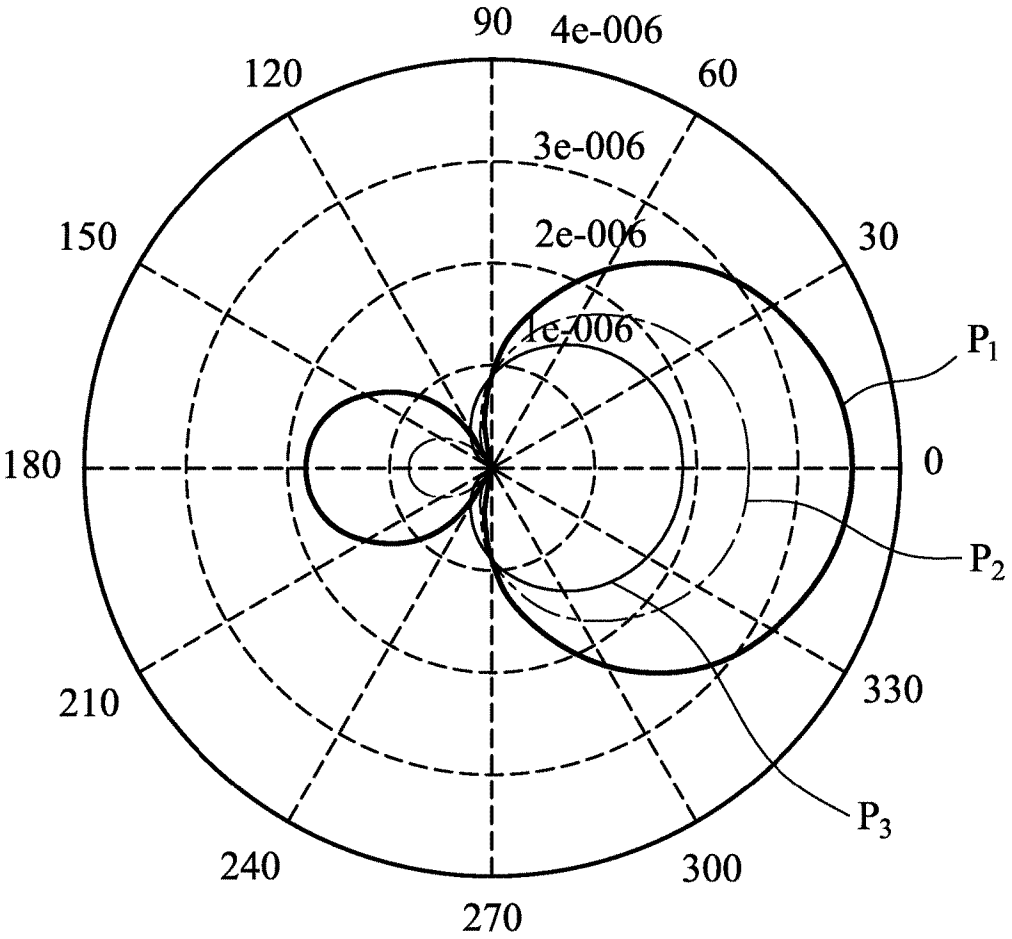
FIG. 5 is a polarity pattern illustrating the relationship between the length of the acoustic tube and the directivity of the microphone according to some embodiments of the present disclosure.
Figure 6:
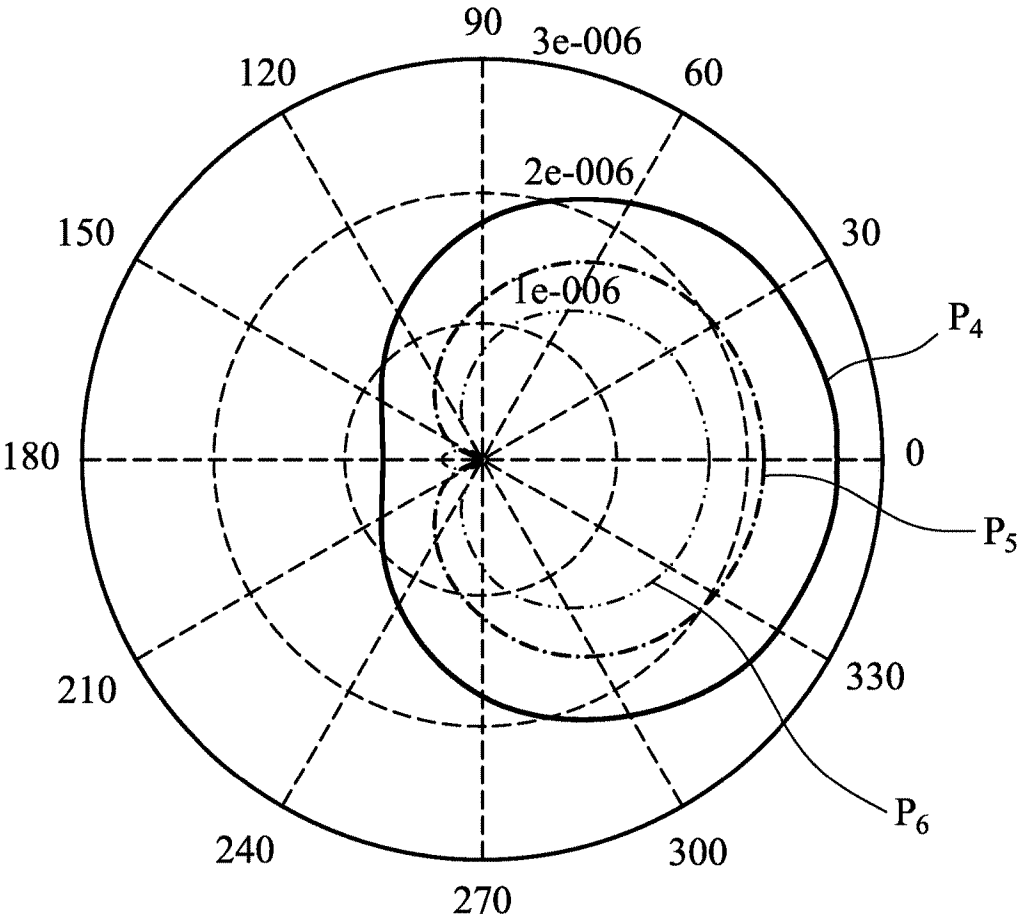
FIG. 6 is a polarity pattern illustrating the relationship between the cross-sectional area of the acoustic tube and the directivity of the microphone according to some embodiments of the present disclosure.

In some embodiments, the directivity of the microphone device 200A can be designed based on the difference between the length $L_{21}$ of the acoustic tube $S_{21}$ and the length $L_{22}$ of the acoustic tube $S_{22}$, as shown in FIG. 5. FIG. 5 shows the polarity pattern $P_1$ of the microphone device 200A having a difference of 8 mm between lengths $L_{21}$ and $L_{22}$, the polarity pattern $P_2$ of the microphone device 200A having a difference of 6 mm between lengths $L_{21}$ and $L_{22}$, and the polarity pattern $P_3$ of the microphone device 200A having a difference of 3 mm between lengths $L_{21}$ and $L_{22}$. As shown in FIG. 6, the directivity of the microphone device 200A increases as the difference between the length $L_{21}$ and the length $L_{22}$ increases. For example, the bi-directional-microphone function performed by the polarity patterns $P_1$ is more obvious than that performed by the polarity patterns $P_2$.

In some embodiments, the directivity of the microphone device 200A can be designed based on the cross-sectional area difference between the acoustic tube $S_{21}$ and the acoustic tube $S_{22}$, as shown in FIG. 6. FIG. 6 shows the polarity pattern $P_4$ of the microphone device 200A having the cross-sectional area of the acoustic tube $S_{22}$ which is equal to the cross-sectional area of the acoustic tube $S_{21}$, the polarity pattern $P_5$ of the microphone device 200A having the cross-sectional area of the acoustic tube $S_{22}$ which is 2 times larger than the cross-sectional area of the acoustic tube $S_{21}$ and the polarity pattern $P_6$ of the microphone device 200A having the cross-sectional area of the acoustic tube $S_{22}$ which is 4 times larger than the cross-sectional area of the acoustic tube $S_{21}$. As shown in FIG. 6, the directivity of the microphone device 200A is designed based on cross-sectional area difference between the acoustic tube $S_{21}$ and the acoustic tube $S_{22}$.

Figure 7A:
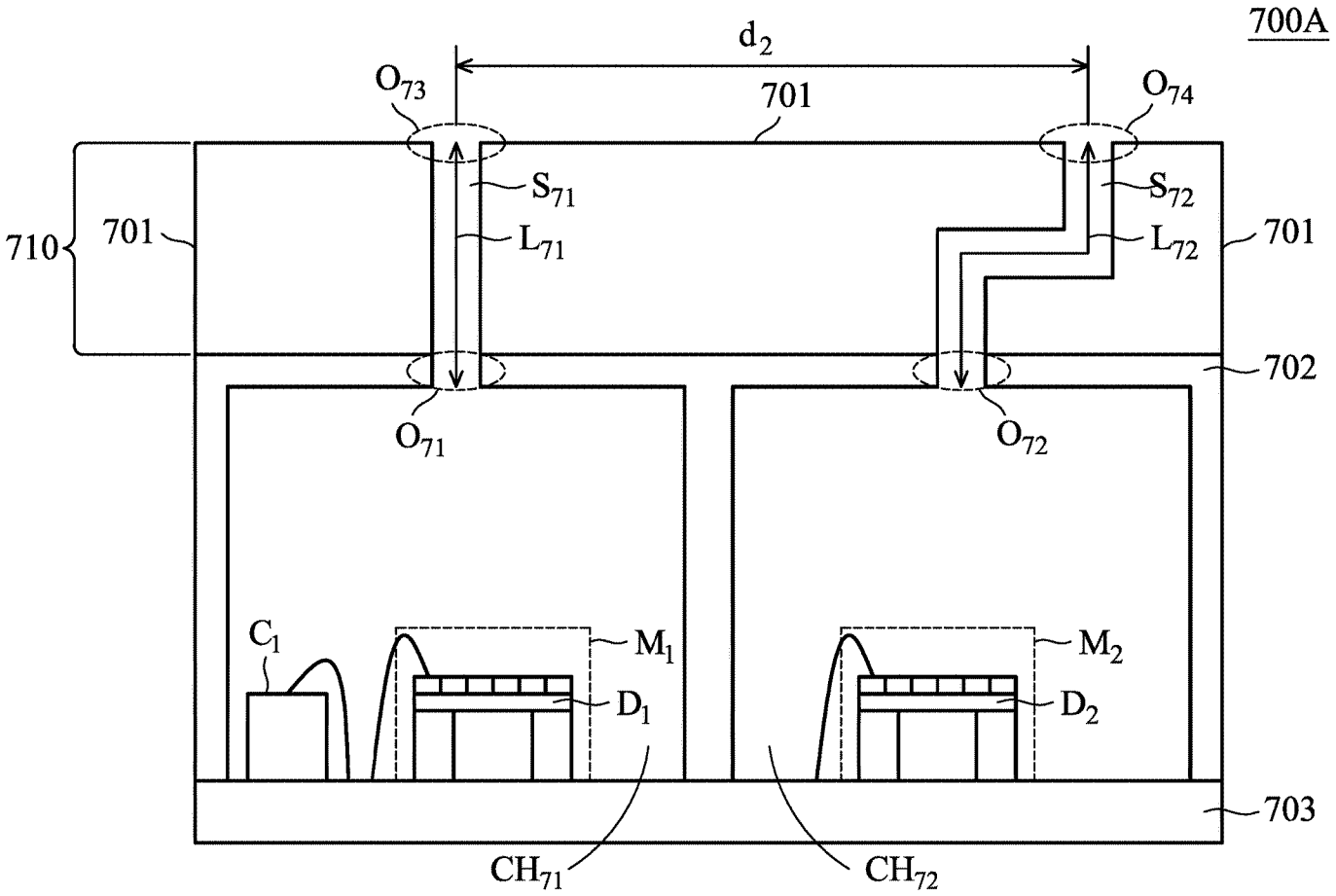
FIG. 7A-7B is a schematic diagram of a microphone device according to an embodiment of the present disclosure.

FIG. 7A is a schematic diagram of a microphone device 700A according to an embodiment of the present disclosure. The microphone device 700A includes the chamber $CH_{71}$, the chamber $CH_{72}$, the acoustic sensor $M_1$, the acoustic sensor $M_2$, the integrated circuit $C_1$ and the sound transmission device 710.

The chamber $CH_{71}$ and chamber $CH_{72}$ are formed by the microphone cover 702 and the circuit board 703 which are coupled to each other. The sound transmission device 710 is formed by the rubber structure 701. The chamber $CH_{71}$ includes the acoustic port $O_{71}$, and the chamber $CH_{72}$ includes the acoustic port $O_{72}$. The acoustic sensor $M_1$ and the integrated circuit $C_1$ are placed inside the chamber $CH_{71}$, and the acoustic sensor $M_2$ is placed inside the chamber $CH_{72}$. The rubber structure 701 includes the acoustic tube $S_{71}$, the acoustic tube $S_{72}$, the acoustic port $O_{73}$, and the acoustic port $O_{74}$. The acoustic tube $S_{71}$ communicates with the acoustic port $O_{71}$ and the acoustic port $O_{73}$, and the acoustic tube $S_{72}$ communicates with the acoustic port $O_{72}$ and the acoustic port $O_{74}$.

As shown in FIG. 7A, the acoustic port $O_{71}$ corresponds to the position of the diaphragm $D_1$, which makes the diaphragm $D_1$ receive sound transmitted from the acoustic port $O_{71}$. The acoustic port $O_{72}$ corresponds to the position of the diaphragm $D_2$, which makes the diaphragm $D_2$ receive sound transmitted from the acoustic port $O_{72}$.

In this embodiment, the length $L_{71}$ of the acoustic tube $S_{71}$ is shorter than the length $L_{72}$ of the acoustic tube $S_{72}$. Accordingly, the sound path (or propagation path) of the sound transmitted to the diaphragm $D_1$ through the acoustic tube $S_{71}$ is shorter than the sound path of the sound transmitted to the diaphragm $D_2$ through the acoustic tube $S_{72}$. Based on the distance $d_2$ and the different length between the acoustic tube $S_{71}$ and the acoustic tube $S_{72}$, the sound may substantially reach both the diaphragm $D_1$ and the diaphragm $D_2$ at the same time that the sound is substantially transmitted in a specific direction. In such cases, the acoustic tube $S_{71}$, the acoustic tube $S_{72}$, and the distance $d_2$ may determine the directivity of the microphone device 700A.

Since the sound path of the acoustic tube $S_{72}$ is longer than the sound path of the acoustic tube $S_{71}$, the sound degradation caused by the acoustic tube $S_{72}$ is greater than the sound degradation caused by the acoustic tube $S_{71}$. In such cases, the sensitivity of the acoustic sensor $M_1$ may be better than the sensitivity of the acoustic sensor $M_2$, which makes the microphone device 700A support two different sensitivities and makes the microphone device 700A have a wider dynamic range. Therefore, the sound transmission device 710 including the acoustic tubes $S_{71}$ and $S_{72}$ can be utilized to determine the directivity of the microphone device 700A and make the microphone device 700A have a wide dynamic range.

In some embodiments, the acoustic tube $S_{71}$ and the acoustic tube $S_{72}$ may have different cross-sectional areas. Since different cross-sectional areas cause different sound degradations, the dynamic range and the directivity of the microphone device 700A can be designed based on different cross-sectional areas of the acoustic tube $S_{71}$ and the acoustic tube $S_{72}$.

Figure 7B:
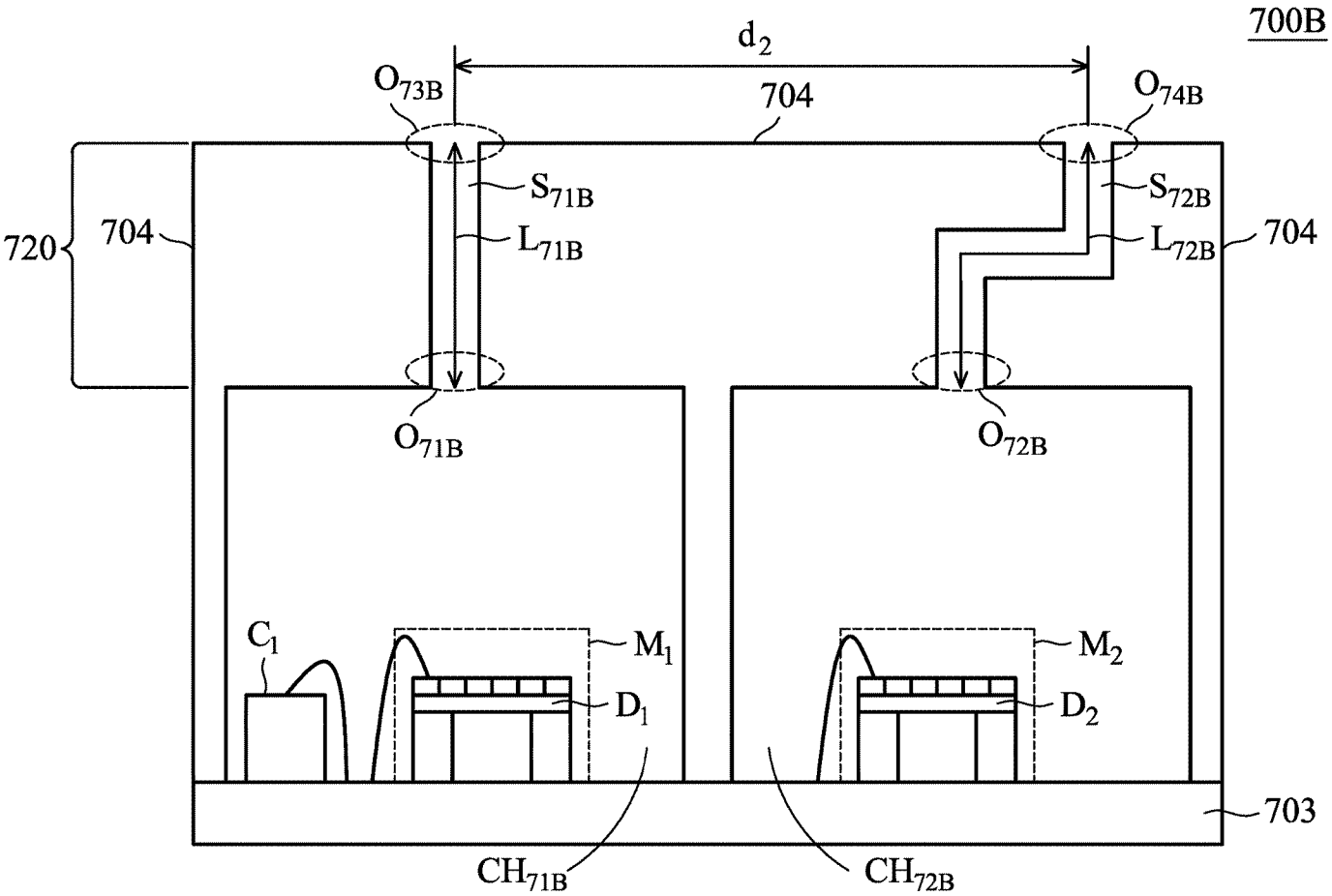

FIG. 7B is a schematic diagram of a microphone device 700B according to an embodiment of the present disclosure. The microphone device 700B includes the chamber $CH_{71B}$, the chamber $CH_{72B}$, the acoustic sensor $M_1$, the acoustic sensor $M_2$, the integrated circuit $C_1$ and the sound transmission device 720.

The chamber $CH_{71B}$ includes the acoustic port $O_{71B}$, and the chamber $CH_{72B}$ includes the acoustic port $O_{72B}$. The acoustic sensor $M_1$ and the integrated circuit $C_1$ are placed inside the chamber $CH_{71B}$, and the acoustic sensor $M_2$ is placed inside the chamber $CH_{72B}$. The chamber $CH_{71B}$ and chamber $CH_{72B}$ are formed by the microphone cover 704 and the circuit board 703 which are coupled to each other. The sound transmission device 720 is formed by the microphone cover 704. The microphone cover 704 includes the acoustic tube $S_{71B}$, the acoustic tube $S_{72B}$, the acoustic port $O_{73B}$, and the acoustic port $O_{74B}$. The acoustic tube $S_{71B}$ communicates with the acoustic port $O_{71B}$ and the acoustic port $O_{73B}$, and the acoustic tube $S_{72B}$ communicates with the acoustic port $O_{72B}$ and the acoustic port $O_{74B}$.

As shown in FIG. 7B, the acoustic port $O_{71B}$ corresponds to the position of the diaphragm $D_1$, which makes the diaphragm $D_1$ receive sound transmitted from the acoustic port $O_{71B}$. The acoustic port $O_{72B}$ corresponds to the position of the diaphragm $D_2$, which makes the diaphragm $D_2$ receive sound transmitted from the acoustic port $O_{72B}$.

In this embodiment, the length $L_{71B}$ of the acoustic tube $S_{71B}$ is shorter than the length $L_{72B}$ of the acoustic tube $S_{72B}$. As described in FIGS. 2A, 2B and 7A, the acoustic tube $S_{71B}$, the acoustic tube $S_{72B}$, and the distance $d_2$ may determine the directivity of the microphone device 700B. As described in FIGS. 2A, 2B and 7A, since the sound path of the acoustic tube $S_{72B}$ is longer than the sound path of the acoustic tube $S_{71B}$, the sensitivity of the acoustic sensor $M_1$ may be better than the sensitivity of the acoustic sensor $M_2$. Therefore, the sound transmission device 720 including the acoustic tubes $S_{71B}$ and $S_{72B}$ can be utilized to determine the directivity of the microphone device 700B and make the microphone device 700B have a wide dynamic range.

In some embodiments, the acoustic tube $S_{71B}$ and the acoustic tube $S_{72B}$ may have different cross-sectional areas. Since different cross-sectional areas cause different sound degradations, the dynamic range and the directivity of the microphone device 700B can be designed based on different cross-sectional areas of the acoustic tube $S_{71B}$ and the acoustic tube $S_{72B}$.

Figure 8:
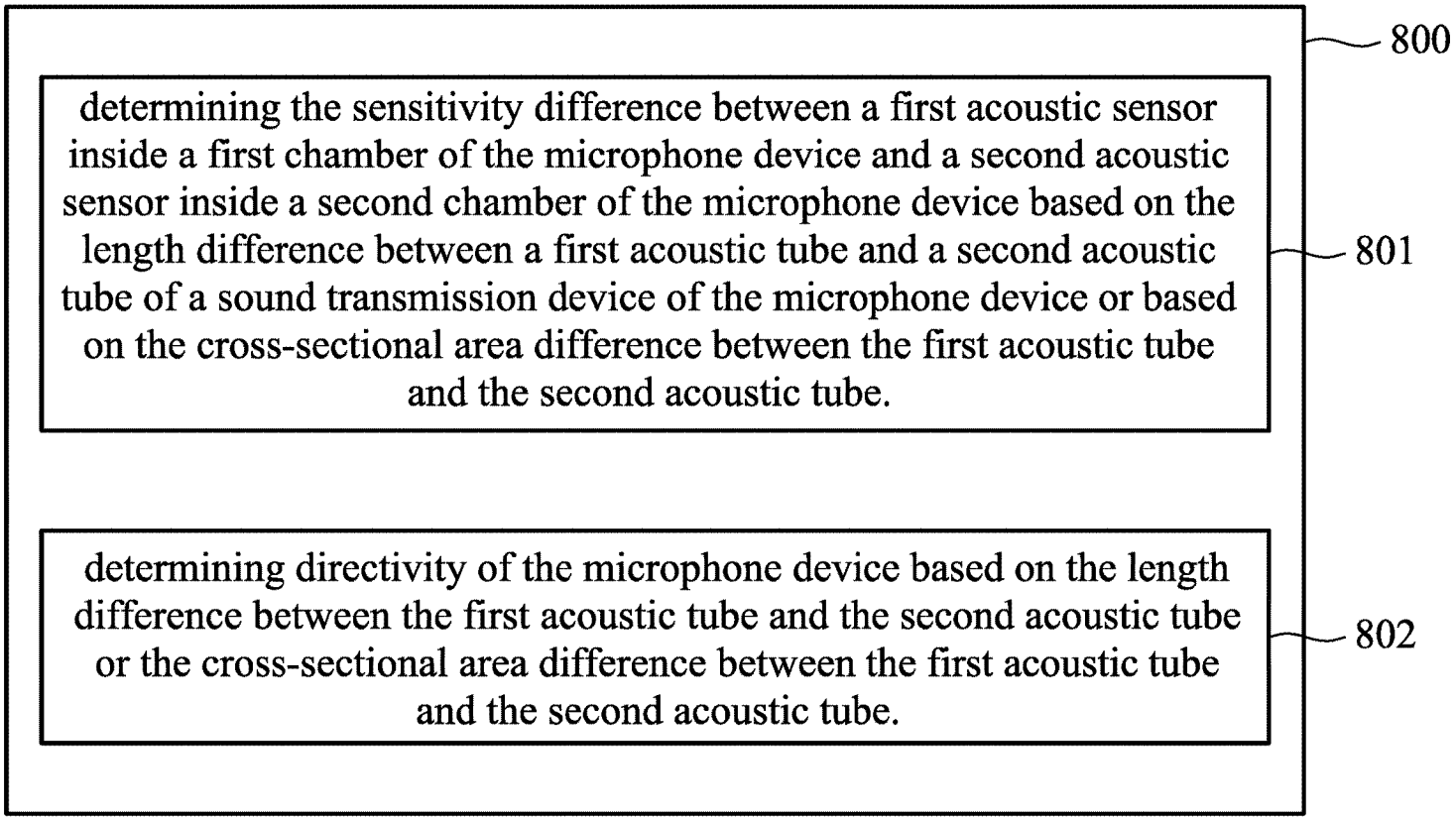
FIG. 8 is a schematic diagram of a control method of a microphone device according to an embodiment of the present disclosure.

FIG. 8 illustrates the control method 800 of a microphone device (e.g., microphone device 200A, 200B, 700A or 700B). The control method 800 comprises at least one of operations 801 and 802. In operation 801, the control method 800 determines the sensitivity difference between a first acoustic sensor (e.g., acoustic sensor $M_1$) inside a first chamber (e.g., chamber $CH_{21}$) of the microphone device and a second acoustic sensor (e.g., acoustic sensor $M_2$) inside a second chamber (e.g., chamber $CH_{22}$) of the microphone device based on the length difference between a first acoustic tube (e.g., acoustic tube $S_{21}$) and a second acoustic tube (e.g., acoustic tube $S_{22}$) of a sound transmission device (e.g., sound transmission device 210) of the microphone device or based on the cross-sectional area difference between the first acoustic tube and the second acoustic tube. In operation 802, the control method 800 determines directivity of the microphone device based on the length difference between the first acoustic tube and the second acoustic tube or the cross-sectional area difference between the first acoustic tube and the second acoustic tube.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A microphone device, comprising:

a first chamber, comprising a first acoustic port;

a second chamber, comprising a second acoustic port;

a first acoustic sensor, arranged in the first chamber;

a second acoustic sensor, arranged in the second chamber;

a first integrated circuit, coupled to the first acoustic sensor and placed inside the first chamber;

a second integrated circuit, coupled to the second acoustic sensor and placed inside the second chamber; and a sound transmission device coupled to the first chamber and the second chamber, comprising:

a third acoustic port;

a fourth acoustic port;

a first acoustic tube, communicating with the first acoustic port and the third acoustic port; and a second acoustic tube, communicating with the second acoustic port and the fourth acoustic port;

wherein directivity of the microphone device is determined based on a length difference between the first acoustic tube and the second acoustic tube or determined based on a cross-sectional area difference between the first acoustic tube and the second acoustic tube;

wherein a sensitivity difference between the first acoustic sensor and the second acoustic sensor is determined based on the length difference or determined based on the cross-sectional area difference;

wherein the first integrated circuit provides a first voltage to the first acoustic sensor, and the second integrated circuit provides a second voltage which is different from the first voltage to the second acoustic sensor;

wherein sensitivity of the first acoustic sensor is different from sensitivity of the second acoustic sensor based on the first voltage and the second voltage.

2. The microphone device as claimed in claim 1, wherein a first sound path of the first acoustic tube is shorter than a second sound path of the second acoustic tube and makes the first acoustic sensor more sensitive than the second acoustic sensor.

3. The microphone device as claimed in claim 2, wherein the first chamber and the second chamber are at least formed by a circuit board and a microphone cover;

wherein the microphone cover is coupled to the circuit board;

wherein the first acoustic port and the second acoustic port are placed on the circuit board;

wherein the sound transmission device is formed by the circuit board, and the third acoustic port and the fourth acoustic port are placed on the exterior of the circuit board.

4. The microphone device as claimed in claim 1, wherein a size of the first chamber and a size of the second chamber are the same;

wherein arrangement of the first integrated circuit and the first acoustic sensor in the first chamber is the same as arrangement of the second integrated circuit and the second acoustic sensor in the second chamber.

5. The microphone device as claimed in claim 2, wherein the first chamber and the second chamber are at least formed by a circuit board and a microphone cover;

wherein the microphone cover is coupled to the circuit board;

wherein the first acoustic port and the second acoustic port are placed on the microphone cover;

wherein the sound transmission device is formed by the microphone cover, and the third acoustic port and the fourth acoustic port are placed on the exterior of the microphone cover.

6. The microphone device as claimed in claim 2, wherein the first chamber and the second chamber are at least formed by a circuit board and a microphone cover;

wherein the microphone cover is coupled to the circuit board;

wherein the microphone device further comprises a rubber structure which is coupled to the microphone cover;

wherein the first acoustic port and the second acoustic port are placed on the microphone cover;

wherein the sound transmission device is formed by the rubber structure, and the third acoustic port and the fourth acoustic port are placed on the exterior of the rubber structure.

7. A microphone device, comprising:

a first chamber, comprising a first acoustic port;

a second chamber, comprising a second acoustic port;

a first acoustic sensor, arranged in the first chamber;

a second acoustic sensor, arranged in the second chamber;

an integrated circuit, coupled to the first acoustic sensor and the second acoustic sensor and placed inside the first chamber or the second chamber; and a sound transmission device coupled to the first chamber and the second chamber, comprising:

a third acoustic port;

a fourth acoustic port;

a first acoustic tube, communicating with the first acoustic port and the third acoustic port; and a second acoustic tube, communicating with the second acoustic port and the fourth acoustic port;

wherein the integrated circuit provides different respective voltages to the first acoustic sensor and the second acoustic sensor;

wherein directivity of the microphone device is determined based on a length difference between the first acoustic tube and the second acoustic tube or determined based on a cross-sectional area difference between the first acoustic tube and the second acoustic tube;

wherein a sensitivity difference between the first acoustic sensor and the second acoustic sensor is determined based on the length difference or determined based on the cross-sectional area difference.

8. The microphone device as claimed in claim 7, wherein the integrated circuit processes signals received by the first acoustic sensor and the second acoustic sensor to control the directivity of the microphone device.

9. The microphone device as claimed in claim 7, wherein the integrated circuit provides different respective voltages to the first acoustic sensor and the second acoustic sensor to make sensitivity of the first acoustic sensor different from sensitivity of the second acoustic sensor.

10. A control method of a microphone device, comprising:

determining a sensitivity difference between a first acoustic sensor inside a first chamber of the microphone device and a second acoustic sensor inside a second chamber of the microphone device based on a length difference between a first acoustic tube and a second acoustic tube of a sound transmission device of the microphone device or based on a cross-sectional area difference between the first acoustic tube and the second acoustic tube; and determining directivity of the microphone device based on the length difference or the cross-sectional area difference;

wherein the sound transmission device is coupled to the first chamber and the second chamber;

wherein the first acoustic tube communicates with a first acoustic port of the first chamber and a third acoustic port of the sound transmission device, and the second acoustic tube communicates with a second acoustic port of the second chamber and a fourth acoustic port of the sound transmission device;

wherein an integrated circuit is coupled to the first acoustic sensor and the second acoustic sensor and placed inside the first chamber or the second chamber;

wherein the integrated circuit provides different respective voltages to the first acoustic sensor and the second acoustic sensor to make sensitivity of the first acoustic sensor different from sensitivity of the second acoustic sensor.

* * * * *